US006916170B2

(12) United States Patent
Kim et al.

(10) Patent No.: US 6,916,170 B2
(45) Date of Patent: Jul. 12, 2005

(54) GAS DRIER

(75) Inventors: Sang Doo Kim, Changwon-si (KR); Jae Suk Yang, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/720,684

(22) Filed: Nov. 25, 2003

(65) Prior Publication Data

US 2004/0154183 A1 Aug. 12, 2004

(30) Foreign Application Priority Data

Nov. 26, 2002 (KR) ..... P10-2002-0074050

(51) Int. Cl.[7] ..... F26B 23/02
(52) U.S. Cl. ..... 431/71; 431/74; 34/551
(58) Field of Search ..... 431/71, 74; 34/551

(56) References Cited

U.S. PATENT DOCUMENTS 3,026,932 A * 3/1962 Algino ..... 431/71
4,325,689 A * 4/1982 Burke ..... 431/74
5,009,588 A * 4/1991 Williams, Jr. ..... 431/71
6,810,602 B2 * 11/2004 Kim et al. ..... 34/547

* cited by examiner

*Primary Examiner*—Sara Clarke
(74) *Attorney, Agent, or Firm*—McKenna Long & Aldridge LLP

(57) ABSTRACT

An apparatus for controlling gas valves in a gas drier is provided. The apparatus includes an igniter, a closed flame detection switch and a sustaining relay. The igniter, which starts a flame, connects to a first terminal which provides a power signal with respect to a neutral terminal. The closed flame detection switch is connected between the igniter and the neutral terminal thereby receiving the power signal via the igniter. The closed flame detection switch also detects a flame by opening. The sustaining relay provides an alternative path of conduction with respect to the closed flame detection switch.

4 Claims, 4 Drawing Sheets

GAS DRIER

This application claims the benefit of Korean Application No. 10-2002-0074050 filed on Nov. 26, 2002, which is hereby incorporated by reference.

BACKGROUND OF THE INVENTION

1. Field of the Invention

The present invention relates to a drier using gas combustion, and more particularly, to an apparatus for controlling the gas valves of such a drier.

2. Discussion of the Related Art

Generally speaking, a laundry drier uses an energy source, such a gas or electricity, to heat a conductor such as a coil, which in turn radiates heat to the surrounding air. The thus-heated air is circulated inside the laundry drier to dry the laundry. FIG. 1 schematically illustrates a gas valve controller of a gas-combustion-type laundry drier according to a related art.

Referring to FIG. 1, a microcomputer 10 outputs an ignition signal according to a user command for generating heated air, to control a normally open start relay 11, which is closed to supply power through a terminal L1 to an igniter 12 for igniting a gas-and-air fuel mixture. When a flame of the igniter 12 is detected, a normally closed flame detection switch 13 is opened. Meanwhile, a normally closed thermostat switch 14 is opened when an overheating condition is detected. To control a fuel supply, first and second valve coils 16 and 17 for controlling respective gas supply valves (not shown) are commonly supplied with a rectified voltage, via a rectifier bridge 18 for rectifying the power applied to the igniter 12 and the voltage felt from the common electrodes of the flame detection and thermostat switches 13 and 14. A pair of photo-couplers 15*a* and 15*b* is employed for transferring to an input port of the microcomputer 10 a flame detection signal from one of the flame detection switch 13 and the second valve coil 17, respectively.

The operation of the circuit of FIG. 1 will now be explained with reference to the timing diagram of FIG. 2.

The microcomputer 10, in response to a user command to start the laundry drier, closes the start relay 11 and thereby transfers power to the igniter 12 for heating to begin. Simultaneously, the first valve coil 16 turns on its valve to supply the gas, using a rectified applied from the rectifier bridge 18. At this time, the flame detection and thermostat switches 13 and 14 are both closed. Subsequently, after the igniter 12 is activated, for as much as twenty to thirty seconds to ignite the gas, the flame detection switch 13 detects a flame and is thus switched to the open state, whereupon the igniter is turned off. As the igniter 12 is turned off, a flame detection signal is applied to the microcomputer 10 and second valve coil 17 through the photocoupler 15*b*. The valve of the second valve coil 17 is thus turned on, and gas combustion is normalized.

After a continuation of the above state of gas combustion, an internal temperature of the gas drier rises, exceeding a set temperature limit according to a controlled characteristic of the thermostat switch 14, which opens to prevent overheating. In doing so, the power supply of the terminal L1 is cut off, thus turning off the valves of first and second valve coils 16 and 17 and in turn stopping the combustion. As the internal temperature drops, the thermostat switch 14 is again closed, to regenerate the gas combustion state.

To close the flame detection switch 13 at the time of regenerating the gas combustion state, however, which has been in an open state, a time longer than the above twenty to thirty seconds is required and is typically as much as thirty to forty seconds. That is, after the thermostat switch 14 has been closed, there is a time lag (gap) of about ten seconds, where the flame detection switch 13 maintains its open state. With the thermostat switched 14 in the closed state as above, a terminal N is connected to the terminal L1 through the rectifier bridge 18 so that the first valve coil 16 is powered and its gas supplying valve remains open. The gas supplying valve of the second valve coil 17 is also open, since the flame detection signal of the flame detection switch 13 is present at the second valve coil through the photo coupler 15*b*. Accordingly, with both gas supplying valves thus open.

Where the time required for heating the igniter 12 to re-ignite the gas is insufficient, whereby ignition fails while gas is discharged (leaked) from the gas valves of the first and second valve coils 16 and 17. That is, the gas leaks from the time that the gas valves are still on to the time that the igniter 12 restarts its heating process. Therefore, in the process of resuming a state of combustion that has been stopped due to an overheating condition, i.e., after an earlier state of combustion, the gas drier according to the related art fails to ignite because of an operation delay of the elements. Moreover, the interim condition of gas leakage is dangerous.

SUMMARY OF THE INVENTION

Accordingly, the present invention is directed to a gas drier that substantially obviates one or more of the problems due to limitations and disadvantages of the related art.

An object of the present invention, which has been devised to solve the foregoing problem, lies in providing a gas drier, which reduces the risk of accidents by preventing a leakage of gas during a time when the igniter fails to ignite the gas.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a gas drier comprising an igniter having a first terminal connected to a power supply terminal to ignite a gas; a flame detection switch having a first terminal connected to a second terminal of the igniter, to maintain a closed state at a normal operating state time, the flame detection switch being a normally closed type switch that is opened when a flame of the igniter is detected; a thermostat switch having one terminal connected to a second terminal of the flame detection switch, to maintain a closed state at a normal operating state, the thermostat switch being a normally closed type switch that is opened by a detection of a state of overheating; a first valve coil having one end grounded; a second valve coil having one end connected to the first terminal of the flame detection switch; a sustaining relay comprising an operating coil having one end connected to the other end of the first valve coil and the other end grounded, and a pair of contacts respectively connected across the flame detection switch; and a rectifier bridge having an output terminal tied in common to the first and second valve coils and the operating coil of the sustaining relay and a pair of input terminals respectively connected to the sustaining relay and the first terminal of the flame detection switch.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiment of the present invention, examples of which are illustrated in the accompanying drawings. Throughout the drawings, like elements are indicated using the same or similar reference designations where possible.

Figure 1:
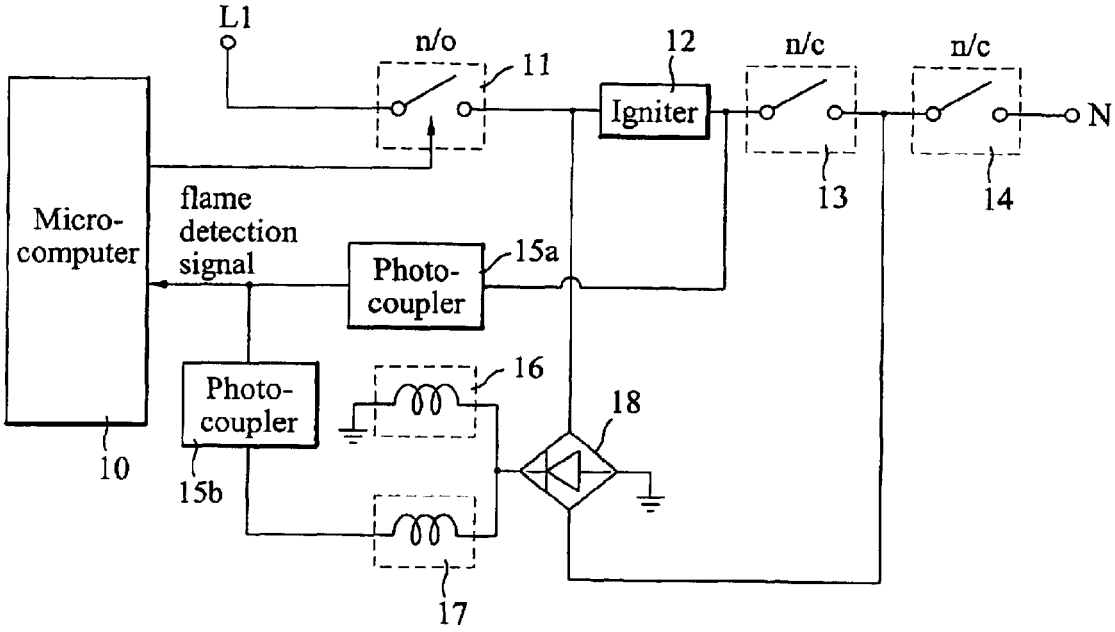
FIG. 1 Related Art
FIG. 1 is a circuit diagram of an apparatus for controlling gas valves in a gas drier according to a related art.
Figure 2:
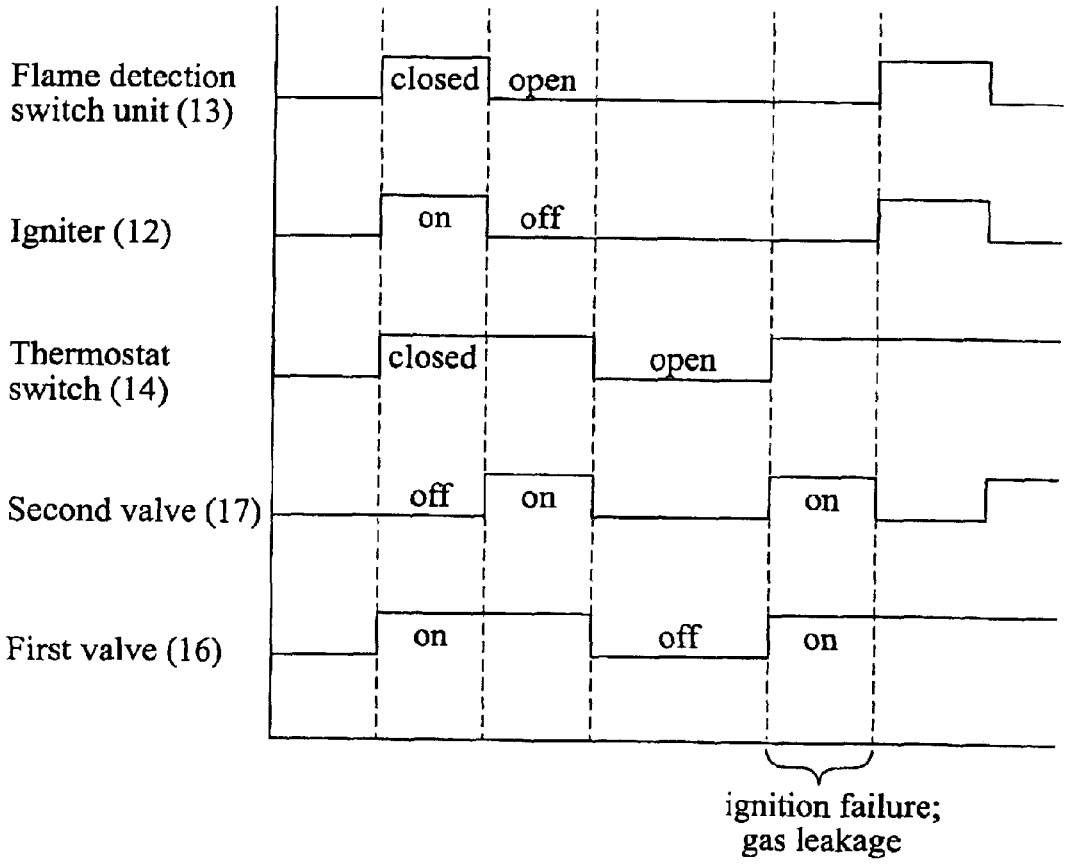
FIG. 2 Related Art
FIG. 2 is a timing diagram for FIG. 1.
Figure 3:
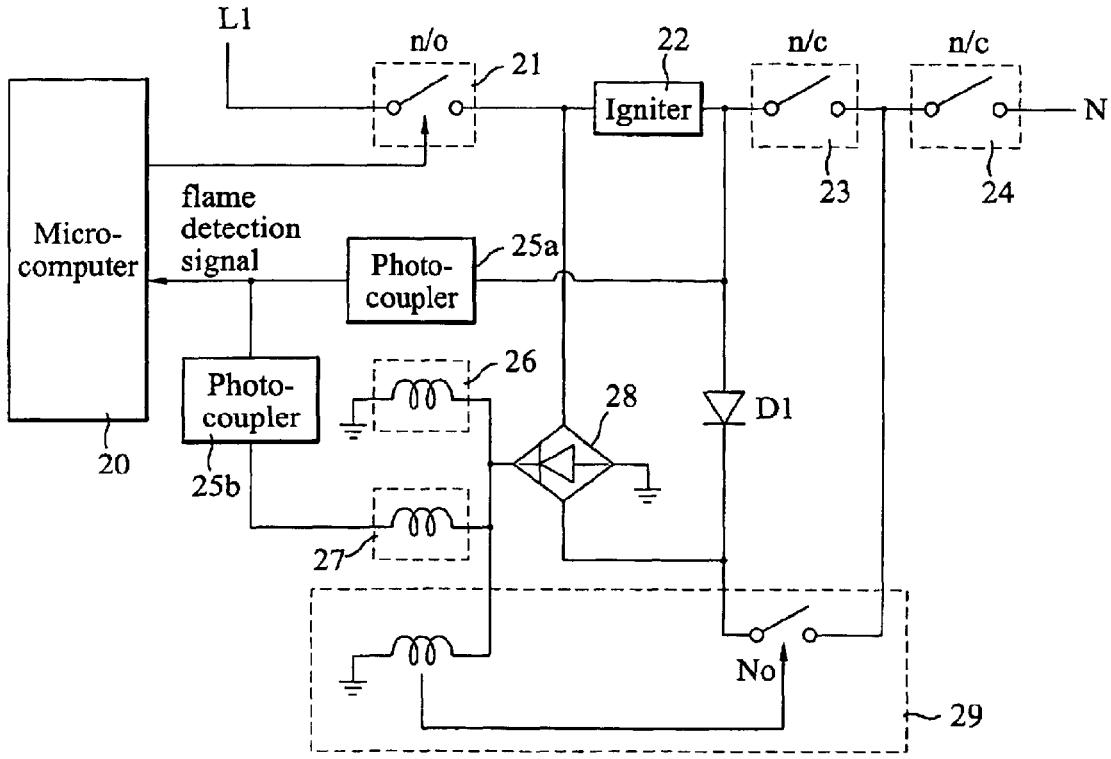
FIG. 3 is a circuit diagram of an apparatus for controlling gas valves in a gas drier according to the present invention.

Referring to FIG. 3, an apparatus for controlling gas valves in a gas drier according to the present invention is comprised of a microcomputer 20, a normally open start relay 21, an igniter 22, a normally closed flame detection switch 23, a normally closed thermostat switch 24, first and second valve coils 26 and 27 each coupled with a relay for controlling respective a gas supply valve (not shown), a rectifier bridge 28, and a pair of photo-couplers 25*a* and 25*b*. The above elements correspond to those of the apparatus of FIG. 1. The present invention further comprises a self-sustaining relay 29 including an operating coil connected in parallel with the first valve 26 for activating a relay consisting of a first contact connected to the input side of the flame detection switch 23 via a rectifying diode Dl and a second contact connected to the output side of the flame detection switch. Thus, the relay of the self-sustaining relay 29 is effectually connected in parallel with the flame detection switch 23, while its coil is connected in parallel with the coils controlling the gas supply valves.

According to the present invention, the microcomputer 20 outputs an ignition signal according to a user command for generating heated air, to control the open start relay 21, which is closed to supply power through a terminal L1 to the igniter 22 for igniting a gas-and-air fuel mixture. When a flame of the igniter 22 is detected, the flame detection switch 23 is opened. Meanwhile, the thermostat switch 24 is opened when an overheating condition is detected. To control a fuel supply, the first and second valve coils 26 and 27 are commonly supplied with a rectified voltage, via the rectifier bridge 28 for rectifying the power applied to the igniter 22 and the voltage felt from the common electrodes of the flame detection and thermostat switches 23 and 24. The photo-couplers 25*a* and 25*b* are employed for transferring to an input port of the microcomputer 20 a flame detection signal from one of the flame detection switch 23 and the second valve coil 27, respectively. Here, photo-couplers are employed to remove the noise present on the various lines of the circuit.

Figure 4:
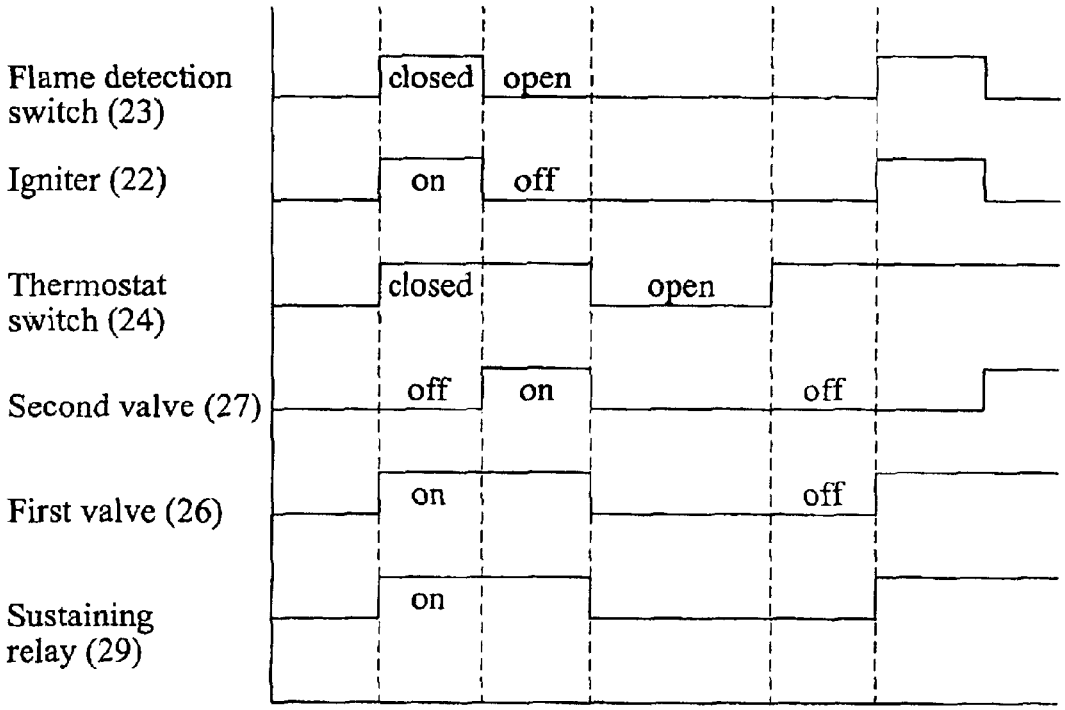
FIG. 4 is a timing diagram for FIG. 3.

The operation of the circuit of FIG. 3 will now be explained with reference to the timing diagram of FIG. 4.

The microcomputer 20, in response to a user command to start the laundry drier, closes the start relay 21 and thereby transfers power to the igniter 22 for heating to begin. Simultaneously, the first valve coil 26 turns on its valve to supply the gas, using a rectified voltage applied from the rectifier bridge 28. At this time, the flame detection and thermostat switches 23 and 24 are both closed. The self-sustaining relay 29 operates with the same timing as the first valve coil 26.

Subsequently, after the igniter 22 is activated, for as much as twenty to thirty seconds to ignite the gas, the flame detection switch 23 detects a flame and is thus switched to the open state, whereupon the igniter is turned off. As the igniter 22 is turned off, a flame detection signal is applied to the microcomputer 20 and second valve coil 27 through the photo-coupler 25*b*. The valve of the second valve coil 27 is thus turned on, and gas combustion is normalized.

After a continuation of the above state of gas combustion, an internal temperature of the gas drier rises, exceeding a set temperature limit according to a controlled characteristic of the thermostat switch 24, which opens to prevent overheating. In doing so, the power supply of the terminal L1 is cut off, thus turning off the valves of first and second valve coils 26 and 27 and in turn stopping the combustion. At the same time, the self-sustaining relay 29 is switched to the open state. As the internal temperature drops, the thermostat switch 24 is again closed, to regenerate the gas combustion state.

To close the flame detection switch 23 at the time of regenerating the gas combustion state, however, which has been in an open state, a time longer than the above twenty to thirty seconds is required and is typically as much as thirty to forty seconds. That is, after the thermostat switch 24 has been closed, there is a time lag (gap) of about ten seconds, where the flame detection switch 23 maintains its open state.

According to the present invention, however, even though the thermostat switch 24 is still closed, there is no power applied to the rectifier bridge 28 since the self-sustaining relay 29 is open. As a result, the valves of the first and second valve coils 26 and 27 remain closed. If after about, say, ten seconds the flame detection switch 23 is switched to the closed state, the igniter 22 starts to be heated and simultaneously power is applied to the rectifier bridge 28. Hence, a terminal N, which is a neutral line with respect to the power of the terminal L1, is connected to the terminal L1 through the rectifier bridge 28 so that the first valve coil 26 is turned on and the self-sustaining relay 29 is switched to the closed state accordingly.

On the other hand, as the igniter 22 is heated for a predetermined time so that the flame detection switch 23 detects the flame to be switched to the open state, the flame detection signal is output to the microcomputer 20 and the second valve coil 27 through the photo-coupler 25*b*, whereby the second valve coil is turned on and the combustion is normalized. Since the self-sustaining relay 29 is closed in the meantime, power is applied to the rectifier bridge 28 despite the open state of the flame detection switch 23, so that the first and second valve coils 26 and 27 remain turned on.

Thus, operation of the self-sustaining relay 29 causes the first valve coil 26 to be turned on by switching the flame detection switch 23 to the closed state during an operation delay time between activation of the igniter 22 and activation of the flame detection switch 23. The flame detection switch 23 then detects the flame of the igniter 22 to be switched to the open state so that the second valve coil 27 is turned on. Hence, even if ignition fails, gas leakage is prevented.

The self-sustaining relay 29 of the present invention may be substituted by a suitable latching relay having an operating coil connected in parallel to the first valve coil 26 and a relay contacts configured such that one terminal is connected to the flame detection switch 23 at a normal operating state and the other terminal is connected to a common node of the flame detection and thermostat switches 23 and 24 when power is applied to the operating coil. An alternative means includes a photo-triac.

The gas drier according to the present invention is constituted using an inexpensive circuit as an apparatus for controlling gas valves. Gas leakage is prevented in case of ignition failure and reducing the risk of accidents accordingly.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A gas drier comprising:

an igniter, connected to a first terminal providing a power signal with respect to a neutral terminal, for initiating a flame;

a normally closed flame detection switch, connected between said igniter and the neutral terminal to receive the power signal via said igniter, for detecting a presence of the initiated flame by opening; and a sustaining relay for providing an alternative path of conduction with respect to said flame detection switch.

2. A gas drier comprising:

an igniter having a first terminal connected to a power supply terminal to ignite a gas;

a flame detection switch having a first terminal connected to a second terminal of said igniter, to maintain a closed state at a normal operating state time, said flame detection switch being a normally closed type switch that is opened when a flame of the igniter is detected;

a thermostat switch having one terminal connected to a second terminal of said flame detection switch, to maintain a closed state at a normal operating state, said thermostat switch being a normally closed type switch that is opened by a detection of a state of overheating;

a first valve coil having one end grounded;

a second valve coil having one end connected to the first terminal of said flame detection switch;

a sustaining relay comprising:

an operating coil having one end connected to the other end of said first valve coil and the other end grounded; and a pair of contacts respectively connected across said flame detection switch; and a rectifier bridge having an output terminal tied in common to said first and second valve coils and the operating coil of said sustaining relay and a pair of input terminals respectively connected to said sustaining relay and the first terminal of said flame detection switch.

3. The apparatus as claimed in claim 2, wherein the contacts of the sustaining relay maintain an open state at the normal operating state and are switched to a closed state when power from said rectifier bridge is applied to the operating coil.

4. The apparatus as claimed in claim 2, further comprising a rectifying diode connected, anode-to-cathode, from the first terminal of said flame detection switch to the corresponding contact of said sustaining relay.

* * * * *